US007296972B2

(12) United States Patent
Liang

(10) Patent No.: US 7,296,972 B2
(45) Date of Patent: Nov. 20, 2007

(54) TURBINE AIRFOIL WITH COUNTER-FLOW SERPENTINE CHANNELS

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 67 days.

(21) Appl. No.: 11/293,461

(22) Filed: Dec. 2, 2005

(65) Prior Publication Data

US 2007/0128028 A1 Jun. 7, 2007

(51) Int. Cl.
*F01D 5/18* (2006.01)

(52) U.S. Cl. ..... 416/97 R; 416/92

(58) Field of Classification Search ..... 415/115; 416/96 R, 97 R, 92
See application file for complete search history.

(56) References Cited

U.S. PATENT DOCUMENTS 4,753,575 A 6/1988 Levengood et al.
4,767,268 A 8/1988 Auxier et al.
5,387,085 A 2/1995 Thomas, Jr, et al.
5,873,695 A * 2/1999 Takeishi et al. ..... 415/115
6,099,252 A 8/2000 Manning et al.
6,126,396 A 10/2000 Doughty et al.
6,164,914 A * 12/2000 Correia et al. ..... 416/97 R
6,220,817 B1 4/2001 Durgin et al.
6,517,312 B1 2/2003 Jones et al.
6,672,836 B2 * 1/2004 Merry ..... 416/97 R
6,705,836 B2 3/2004 Bourriaud et al.
6,832,889 B1 12/2004 Lee et al.
2003/0044278 A1 3/2003 Eneau et al.
2004/0076519 A1 4/2004 Halfmann et al.
2005/0031445 A1 2/2005 McClelland

FOREIGN PATENT DOCUMENTS

EP 1065343 A2 1/2001
JP 2003322003 A 11/2003

* cited by examiner

*Primary Examiner*—Ninh H. Nguyen

(57) ABSTRACT

A turbine airfoil usable in a turbine engine and having at least one cooling system. The cooling system may include a pressure side serpentine cooling channel and a suction side serpentine cooling channel. The cooling channels may be nested within each other to optimize heat exchange between the cooling fluids and the materials forming the airfoil, to reduce the amount of cooling fluids required, to reduce the required pressure of the cooling fluids, and to provide other benefits. The pressure side serpentine cooling channel may pass cooling fluids chordwise towards the trailing edge, and the suction side serpentine cooling channel may pass cooling fluids chordwise towards the leading edge.

20 Claims, 5 Drawing Sheets

TURBINE AIRFOIL WITH COUNTER-FLOW SERPENTINE CHANNELS

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine airfoils are formed from an elongated portion having a tip at one end and a root coupled to a platform at an opposite end of the airfoil. The root is configured to be coupled to a disc. The airfoil is ordinarily composed of a leading edge, a trailing edge, a suction side, and a pressure side. The inner aspects of most turbine airfoils typically contain an intricate maze of cooling circuits forming a cooling system. The cooling circuits in the airfoils receive air from the compressor of the turbine engine and pass the air through film cooling channels throughout the airfoil. The cooling circuits often include multiple flow paths that are designed to maintain all aspects of the turbine airfoil at a relatively uniform temperature. At least some of the air passing through these cooling circuits is exhausted through orifices in the leading edge, trailing edge, suction side, and pressure side of the airfoil.

Many conventional turbine airfoils have cooling channels positioned at the leading and trailing edges and the outer walls. The airfoils often have a mid-chord cooling channel that may have a serpentine configuration or other design. Often times, the cooling channel is pressurized with cooling fluids to provide adequate cooling fluids to all portions of the cooling channels forming the cooling system in the airfoil. The walls forming the pressurized mid-chord cooling channel often remain at temperatures much lower than other portions of the airfoil in contact with hot combustion gases, thereby resulting in a large thermal gradient between these regions. The large thermal gradient often results in a reduced mechanical life cycle of airfoil components and poor thermal mechanical fatigue (TMF). Therefore, the inner cooling channel often negatively affects the life cycle of the airfoil. Thus, a need exists for a turbine airfoil having increased cooling efficiency for dissipating heat while reducing the thermal gradient between the cooling channels and the hot combustion gases.

FIG. 1 shows an external pressure profile for an airfoil. For a conventional five pass serpentine mid-chord cooling channel, cooling fluid is discharged on the pressure and suction sides. The pressure side of the airfoil has a higher external pressure than the suction side, and thereby is used to determine the pressure of the cooling fluid within the cooling system of the airfoil. In order to meet back flow margin criteria, a high cooling supply pressure is needed for this particular design, which results in a large leakage flow of cooling fluids. The second, third, and fourth passes of the serpentine cooling channel typically include film cooling holes for both the pressure and suction sides. In order to meet the back flow margin criteria for the pressure side film cooling holes, the pressure of the cooling fluid within the serpentine cooling channel is approximately ten percent higher than the pressure side external hot gas pressure. This results in over-pressurizing the suction side film cooling holes, which results in tremendous cooling system inefficiencies.

SUMMARY OF THE INVENTION

This invention is directed to a turbine airfoil having a cooling system in inner aspects of the turbine airfoil for use in turbine engines. The cooling system may be used in any turbine blade. The cooling system may include a pressure side serpentine cooling channel nested with a suction side serpentine cooling channel and positioned within a mid-chord region of the airfoil. Nesting the pressure side serpentine cooling channel within the suction side serpentine cooling channel optimizes heat exchange between the cooling fluids and the materials forming the airfoil to reduce the amount of cooling fluids required, to reduce the required pressure of the cooling fluids, and to provide other benefits.

The turbine airfoil may be formed by a generally elongated airfoil formed from an outer wall, a leading edge, a trailing edge, a pressure side, a suction side, a tip at a first end, a root coupled to the airfoil at an end generally opposite to the first end for supporting the airfoil and for coupling the airfoil to a disc, and at least one cavity in the elongated airfoil forming a cooling system in the airfoil.

The cooling system may include a pressure side serpentine cooling channel and a suction side serpentine cooling channel. The pressure side serpentine cooling channel may be formed from a first outboard channel, a first inboard channel coupled to an outboard end of the first outboard channel and extending toward the root, and a second outboard channel coupled to an inboard end of the first inboard channel and extending toward the tip. The suction side serpentine cooling channel may be formed from a first outboard channel and a first inboard channel coupled to an outboard end of the first outboard channel and extending toward the root. The suction side serpentine cooling channel may also include a second outboard channel attached to an inboard end of the first inboard channel and extending toward the tip.

The first outboard channel of the suction side serpentine cooling channel may be positioned between the second outboard channel of the pressure side serpentine cooling channel and the trailing edge of the airfoil. The first inboard channel of the suction side serpentine cooling channel may be positioned between the first inboard channel of the pressure side serpentine cooling channel and second outboard channel of the pressure side serpentine cooling channel. The second outboard channel of the suction side serpentine cooling channel may be positioned chordwise between the first inboard channel of the pressure side serpentine cooling channel and the first inboard channel of the suction side serpentine cooling channel. In an alternative embodiment, the first outboard and first inboard channels of the suction side serpentine cooling channel may be positioned between the first outboard channel and the first inboard channel of the pressure side serpentine cooling channel.

The pressure side serpentine cooling channel may exhaust cooling fluids through film cooling orifices in the outer wall of the pressure side. The suction side serpentine cooling channel may exhaust cooling fluids through film cooling orifices in the outer wall of the suction side or an orifice extending between an outboard end of the second outboard channel of the suction side serpentine cooling channel and an outer surface of the tip, or both.

The cooling system may include at least one leading edge cooling channel extending generally spanwise in close proximity to the leading edge of the elongated airfoil. A plurality of impingement orifices may be positioned in a rib positioned in the at least one leading edge cooling channel. A plurality of trip strips may protrude from inner surfaces of the at least one leading edge cooling channel, and the suction side and pressure side serpentine cooling channels. The cooling system may also include at least one trailing edge cooling chamber extending generally spanwise in close proximity to the trailing edge of the elongated airfoil. The trailing edge cooling chamber may include a plurality of impingement orifices positioned in a first spanwise rib in the at least one trailing edge cooling channel and a plurality of impingement orifices in a second spanwise rib positioned between the first spanwise rib and the trailing edge of the elongated airfoil. The impingement orifices in the second rib may be offset spanwise from the impingement orifices in the first rib. The trailing edge cooling channel may also include a plurality of trip strips protruding from inner surfaces of the at least one leading edge cooling channel, and the suction side and pressure side serpentine cooling channels.

The cooling system may also include a cooling fluid supply chamber in the root of the elongated airfoil. An inboard end of the first outboard channel of the pressure side serpentine cooling channel and an inboard end of the first outboard channel of the suction side serpentine cooling channel may be coupled to the cooling fluid supply chamber. The cooling system may also include a central cooling fluid supply channel coupled to an inboard end of the first inboard channel of the pressure side serpentine cooling channel and an inboard end of the second outboard channel of the pressure side serpentine cooling channel. The central cooling fluid supply channel may separated from the cooling fluid supply channel by a plate that may or may not be removable.

During use, cooling fluids may be passed into the cooling system in the turbine airfoil. In particular, the cooling fluids may be passed into the pressure side serpentine cooling channel and flow generally back and forth spanwise while flowing chordwise toward the trailing edge. A portion of the cooling fluids may also be passed into the suction side serpentine cooling channel that may pass cooling fluids back and forth spanwise while moving the fluids generally toward the leading edge. In this configuration, the cooling fluids move in a counter-flow relationship. It at least one embodiment, the pressure side and suction side serpentine cooling channels may extend from an inner surface of the pressure side to an inner surface of the suction side. The pressure side serpentine cooling channel may exhaust cooling fluids through the pressure side of the airfoil, and the suction side serpentine cooling channel may exhaust cooling fluids through the suction side of the airfoil.

An advantage of this invention is that the pressure side serpentine cooling channel is tailored to account for the high temperatures encountered by the pressure side of the airfoil. By initiating the pressure side serpentine cooling channel proximate to the leading edge cooling channel, the pressure of cooling fluid supply may be reduced, which results in an overall reduction in cooling fluid leakage flow in the system.

Another advantage of this invention is that the cooling system is formed from four independent cooling channels, the leading edge and trailing edge cooling channel, and the pressure side and suction side serpentine cooling channels, all of which may be individually tailored for their independent cooling requirements and aerodynamic pressure requirements.

Yet another advantage is that having four independent cooling channels creates flexibility in the system to be adapted for different uses in the future.

Another advantage of this invention is that the separation of the pressure side and suction side serpentine cooling channels eliminates conventional mid-chord cooling fluid flow mal-distribution due to film cooling flow mal-distribution, film cooling hole size, mainstream cooling fluid pressure variation, back-flow margin (BFM), and high blowing ratio for the blade suction side film cooling holes.

Still another advantage of this invention is that the pressure side and suction side serpentine cooling channels eliminate the pressure differential that typically occurs in conventional cooling channel configurations between pressure and suction sides in a single channel.

Another advantage of this invention is that the counter-flow of cooling fluid between the pressure side and suction side serpentine cooling channels yields a more uniform temperature distribution for the airfoil mid-chord section.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
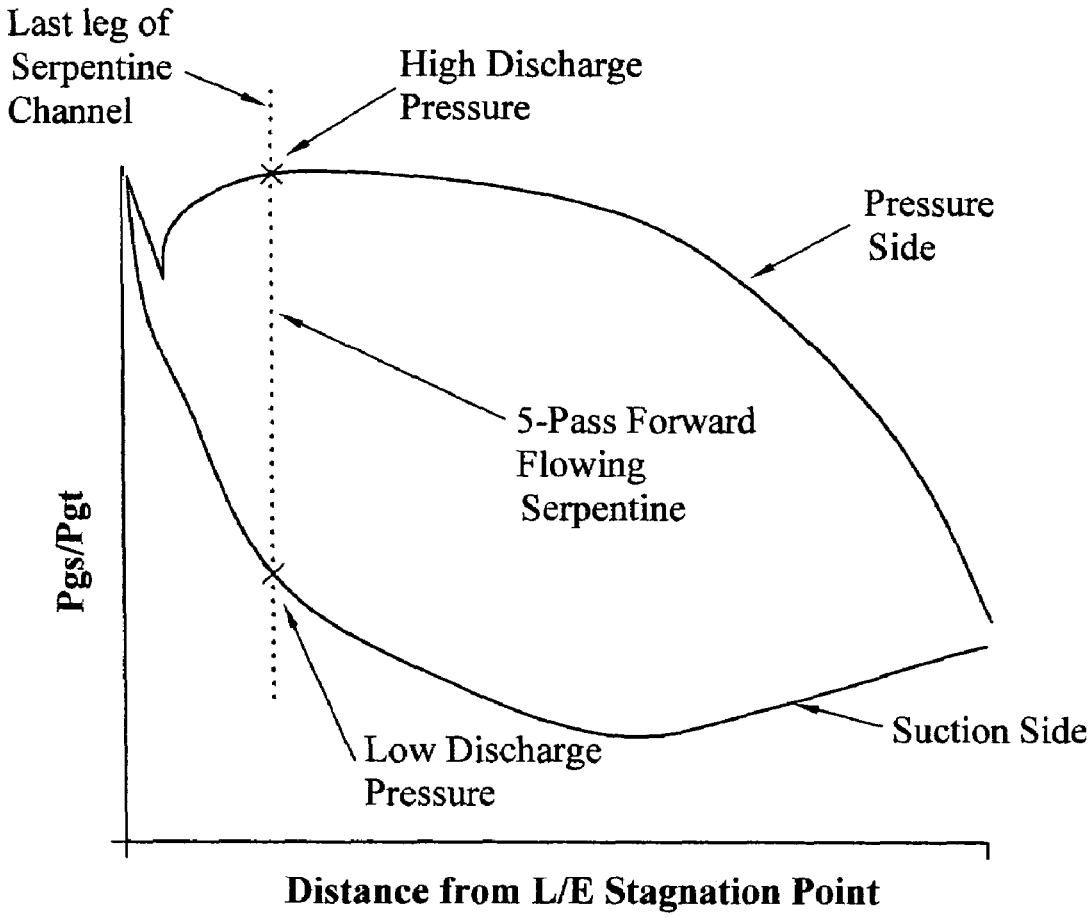
FIG. 1 (PRIOR ART)
FIG. 1 is a graph of a pressure profile of the external pressure profile of a turbine airfoil having a conventional serpentine mid-chord cooling system.

As shown in FIGS. 2-6, this invention is directed to a turbine airfoil 10 having a cooling system 12 in inner aspects of the turbine airfoil 10 for use in turbine engines. The cooling system 12 may be used in any turbine blade. The cooling system 12 may include a suction side serpentine cooling channel 16 nested within a pressure side serpentine cooling channel 14 and positioned within a mid-chord region 18 of the airfoil 10. Nesting the pressure side serpentine cooling channel 14 within the suction side serpentine cooling channel 16 optimizes heat exchange between the cooling fluids and the materials forming the airfoil 10, reduces the amount of cooling fluids required, reduces the required pressure of the cooling fluids, and provides other benefits.

Figure 2:
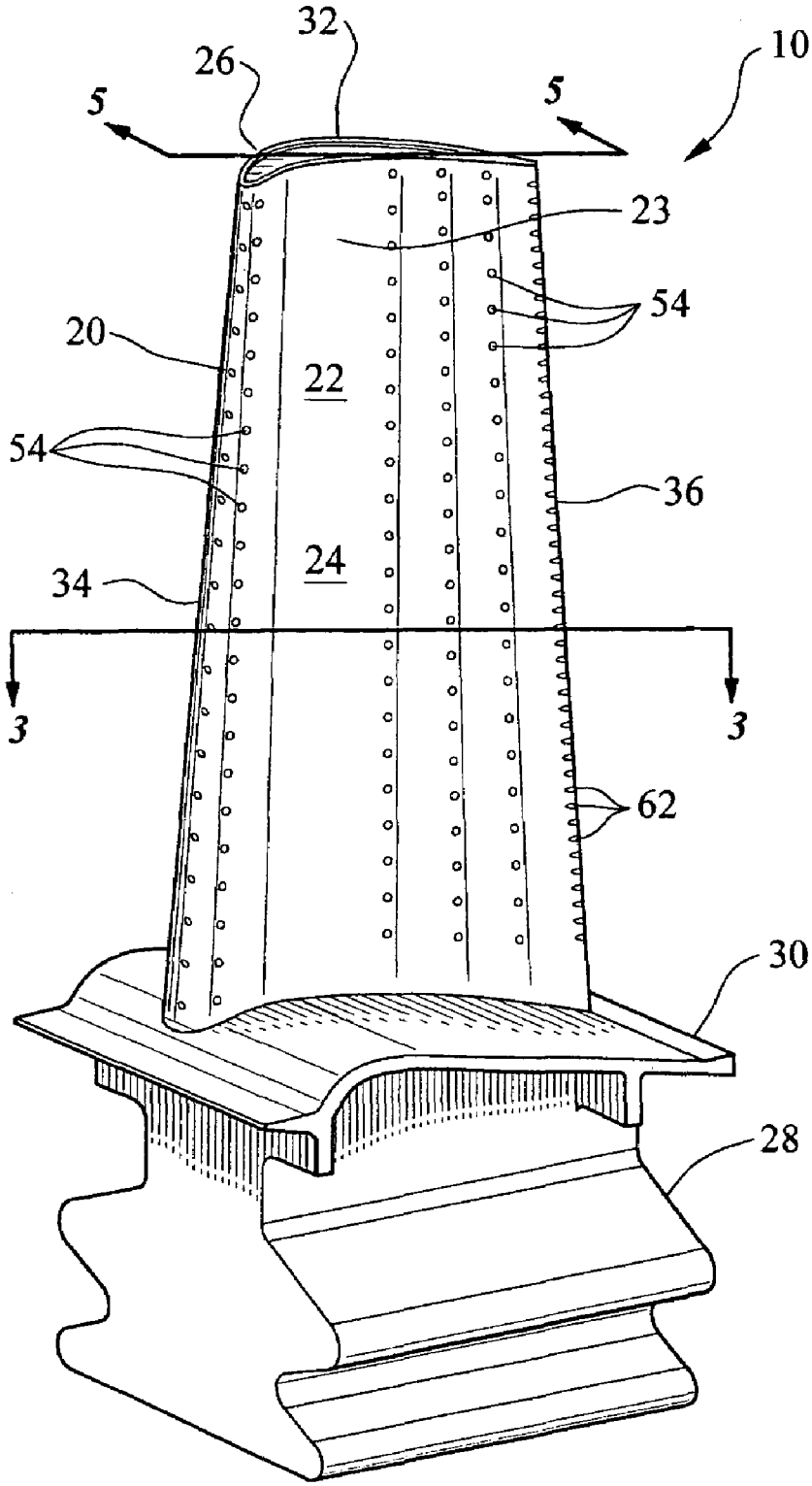
FIG. 2 is a perspective view of a turbine airfoil having features according to the instant invention.

As shown in FIG. 2, the turbine airfoil 10 may be formed from a generally elongated airfoil 20 having an outer surface 22 adapted for use, for example, in an axial flow turbine engine. Outer surface 22 of the outer wall 23 may have a generally concave shaped portion forming a pressure side 24 and a generally convex shaped portion forming a suction side 26. The generally elongated airfoil 20 may be coupled to a root 28 at a platform 30. The turbine airfoil 10 may be formed from conventional metals or other acceptable materials. The generally elongated airfoil 20 may extend from the root 28 to a tip 32 and include a leading edge 34 and trailing edge 36.

Figure 3:
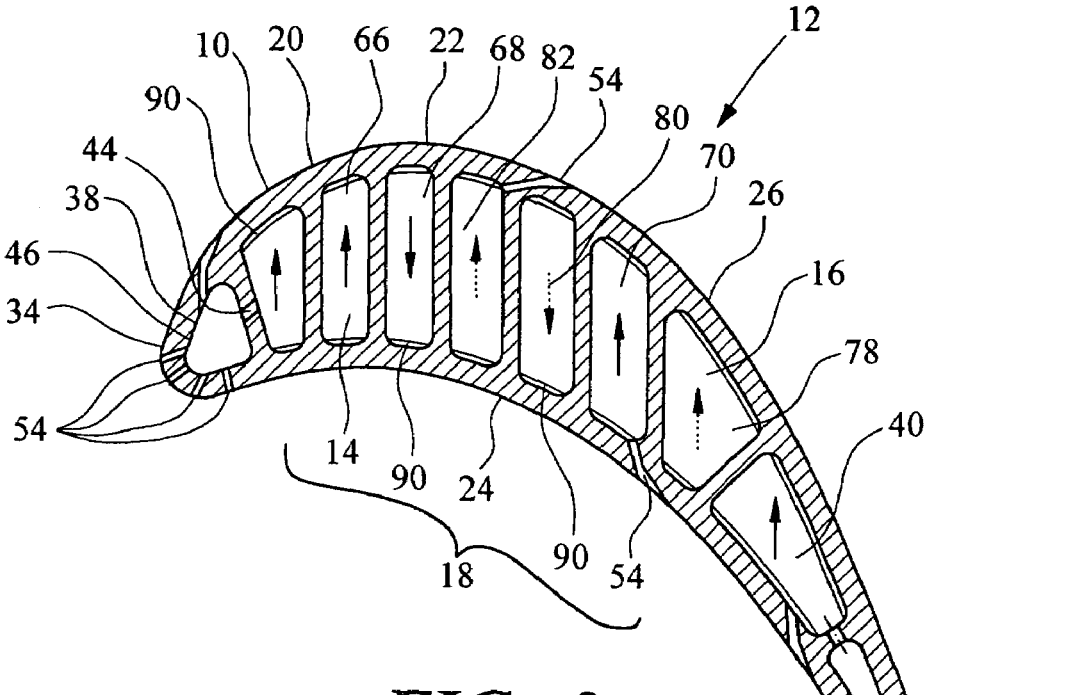
FIG. 3 is a cross-sectional view of the turbine airfoil shown in FIG. 2 taken along channel line 3-3.
Figure 4:
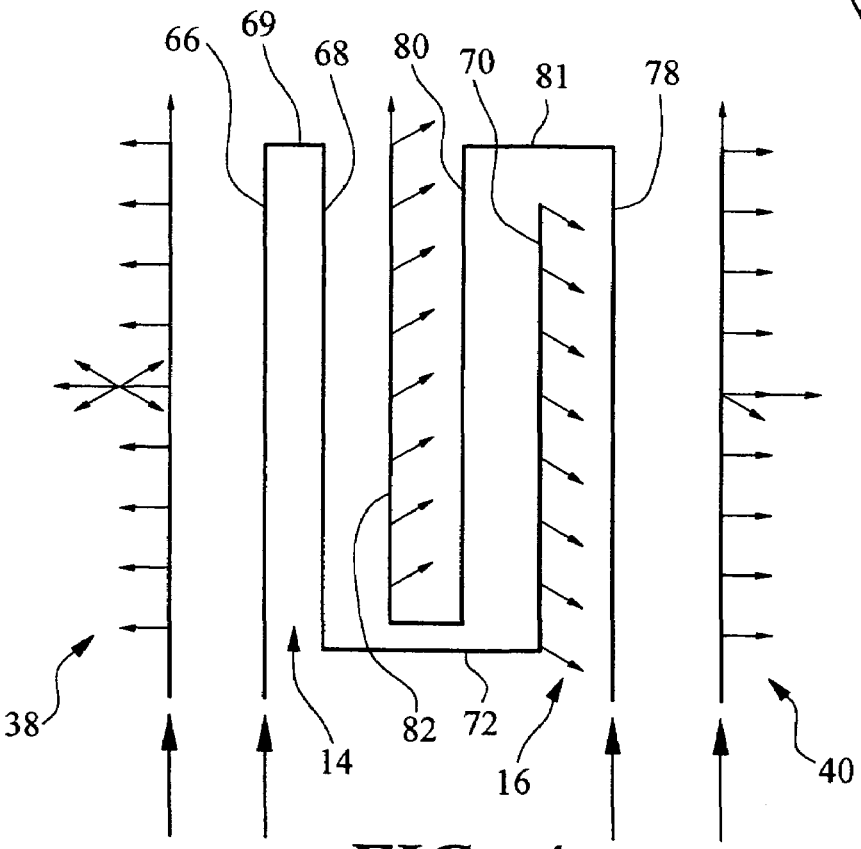
FIG. 4 is a schematic view of the cooling fluid flow through the cooling system of the invention.
Figure 5:
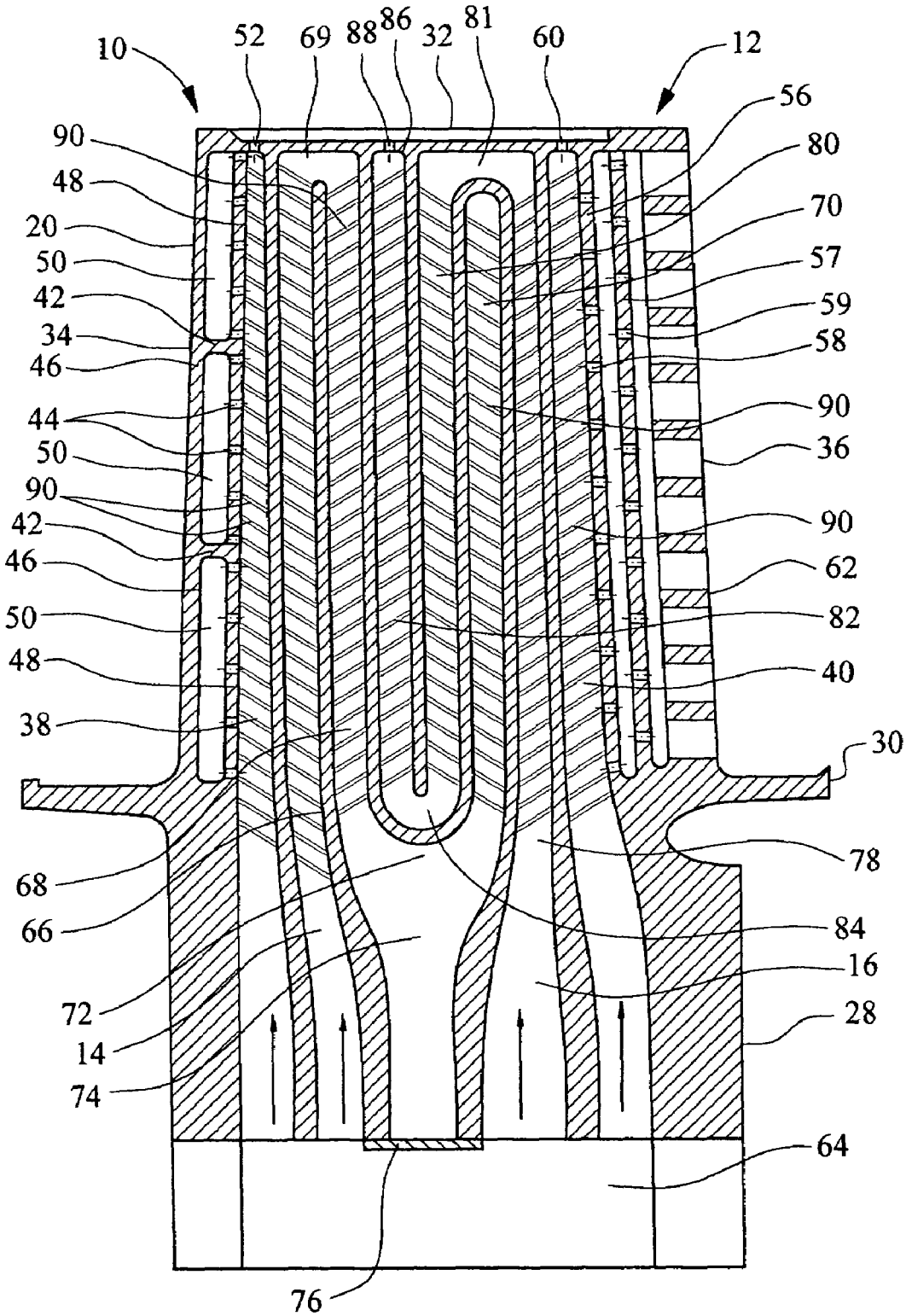
FIG. 5 is a cross-sectional, filleted view of the turbine airfoil shown in FIG. 2 taken along channel line 5-5.

The airfoil 10 may include one or more leading edge cooling channels 38 extending generally spanwise in close proximity to the leading edge 34 of the airfoil 10, as shown in FIG. 3. The leading edge cooling channel 38 may extend from the root 28 to a position in close proximity to the tip 32 of the airfoil 10. The leading edge cooling channel 38 is not limited to a particular configuration but may have any configuration necessary to cool the leading edge 34 and surrounding areas of the airfoil 10. In at least one embodiment, as shown in FIG. 5, the leading edge cooling channel 38 may include a spanwise rib 48 having a plurality of impingement orifices 44 positioned to direct cooling fluids onto a back surface 46 of the leading edge 34. A plurality of ribs 42 extending chordwise may create a plurality of cavities 50 in the leading edge cooling channel 38. In at least one embodiment, the chordwise ribs 42 may create three cavities 50 in the leading edge cooling channel 38. The leading edge cooling channel 38 may exhaust cooling fluids through an exhaust orifice 52 in the tip 32 and through film cooling orifices 54 in the leading edge 34, as shown in FIGS. 1 and 3.

The airfoil 10 may also include one or more trailing edge cooling channels 40 extending generally spanwise in close proximity to the trailing edge 36 of the airfoil 10. The trailing edge cooling channel 40 may extend from the root 28 to a position in close proximity to the tip 32 of the airfoil 10. The trailing edge cooling channel 40 is not limited to a particular configuration but may have any configuration necessary to cool the trailing edge 36 and surrounding areas of the airfoil 10. In at least one embodiment, the trailing edge cooling channel 40 may include one or more spanwise ribs 56 having a plurality of impingement orifices 58. In at least one embodiment, the trailing edge cooling channel 40 may include a plurality of spanwise ribs 56, in which the impingement orifices 58 may be offset from orifices 59 in adjacent ribs 57 This configuration causes cooling fluids flowing through the impingement orifices 58 to impinge upon a downstream spanwise rib 56. The trailing edge cooling channel 40 may exhaust cooling fluids through an exhaust orifice 60 in the tip 32 and through trailing edge exhaust orifices 62.

The pressure side serpentine cooling channel 14, as shown in FIG. 5, may be nested with the suction side serpentine cooling channel 16. The pressure side serpentine cooling channel 14 may be attached to a cooling fluid supply chamber 64 positioned in the root 28. The pressure side serpentine cooling channel 14 may have a first outboard channel 66 extending generally spanwise from the cooling fluid supply chamber 64 toward the tip 32. In at least one embodiment, the first outboard channel 66 may extend to within close proximity of the tip 32 of the airfoil 20. The first outboard channel 66 may not include film cooling orifices 54. Rather, the film cooling orifices 54 may be placed in downstream cooling channels. The pressure side serpentine cooling channel 14 may include a first inboard channel 68 coupled to an outboard end 69 of the first outboard channel 66 and extending generally spanwise toward the root 28 of the airfoil 20. In at least one embodiment, the first inboard channel 68 may extend into the root 28 of the airfoil 20. The pressure side serpentine cooling channel 14 may also include a second outboard channel 70 coupled to an inboard end 72 of the first inboard channel 68. As shown in FIG. 5, the first inboard channel 68 and the second outboard channel 70 may be coupled together at a central cooling fluid supply channel 74. The central cooling fluid supply channel 74 is positioned generally within the root 28 of the airfoil 10. The central cooling fluid supply channel 74 may be sealed in a closed condition with a plate 76, which may or may not be removable. The second outboard channel 70 may extend generally spanwise toward the tip 32. In at least one embodiment, the second outboard channel 70 may extend to within close proximity of the tip 32. Cooling fluids passing through the pressure side serpentine cooling channel 14 may be exhausted through the film cooling orifices 54 in the second outboard channel 70.

The cooling system may also include the suction side serpentine cooling channel 16. The suction side serpentine cooling channel 16 may include a first outboard channel 78 extending generally spanwise from the cooling fluid supply channel 64 toward the tip 32. In at least one embodiment, the suction side serpentine cooling channel 16 may extend to within close proximity of the tip 32. The suction side serpentine cooling channel 16 may also include a first inboard channel 80 coupled to an outboard end 81 of the first outboard channel 78 and extending generally spanwise toward the root 30. In at least one embodiment, the first inboard channel 80 may extend into the root 30. The suction side serpentine cooling channel 16 may also include a second outboard channel 82 coupled to an inboard end 84 of the first inboard channel 80 and extending generally spanwise toward the tip 32. In at least one embodiment, the second outboard channel 82 may extend to within close proximity of the tip 32. An exhaust orifice 88 may extend between an outboard end 86 of the second outboard channel 82 and the tip 32 to exhaust cooling fluids from the suction side serpentine cooling channel 16. Cooling fluids may also be exhausted through film cooling orifices 54, as shown in FIG. 1.

In one embodiment, the pressure side serpentine cooling channel 14 may be nested with the suction side serpentine cooling channel 16 as shown in FIG. 5. More specifically, the second outboard channel 70 of the pressure side serpentine cooling channel 14 may be positioned between the first outboard channel 78 of the suction side serpentine cooling channel 16 and the first inboard channel 80 of the suction side serpentine cooling channel 16. The suction side serpentine cooling channel 16 may be positioned such that the first inboard channel 80 and the second outboard channel 82 are positioned between the second outboard channel 70 of the pressure side serpentine cooling channel 14 and the first inboard channel 68 of the pressure side serpentine cooling channel 14. In an alternative embodiment, the first outboard and first inboard channels 78, 80 of the suction side serpentine cooling channel 16 are positioned between the first outboard channel 66 and the first inboard channel 68 of the pressure side serpentine cooling channel 14.

By configuring the pressure and suction side serpentine cooling channels 14, 16 in this manner, the cooling fluid flowing through the pressure side serpentine cooling channel 14 travels in a chordwise direction from the leading edge 34 toward the trailing edge 36. The cooling fluid flowing through the suction side serpentine cooling channel 16 travels in a chordwise direction from the trailing edge 36 to the leading edge 34. Thus, the cooling fluid flow through the pressure and suction side serpentine cooling channels 14, 16 is a counter-flow of cooling fluids between the pressure and suction side serpentine cooling channels 14, 16.

The cooling system 12 may also include a plurality of turbulence protrusions, such as trip strips 90, extending from surfaces of the leading and trailing edge cooling channels 38, 40 and from the pressure and suction side serpentine cooling channels 14, 16. The trip strips 90 may be positioned generally orthogonal to a general direction of fluid flow through the cooling channels 14, 16, 38, 40.

In at least one embodiment, the pressure side and suction side serpentine cooling channels 14, 16 may extend from an inner surface of the pressure side 24 to an inner surface of the suction side 26. The pressure side serpentine cooling channel 14 may exhaust cooling fluids through the pressure side 24 of the airfoil, and the suction side serpentine cooling channel 16 may exhaust cooling fluids through the suction side 26 of the airfoil 10.

During use, cooling fluids may be passed from the cooling fluid supply chamber 64 into the leading and trailing edge cooling channels 38, 40, the pressure side serpentine cooling channel 14, and the suction side serpentine cooling channel 16. The cooling fluids may enter the leading edge cooling channel 38, as shown in FIG. 3, pass through the impingement orifices 44, and impinge on the back surface 46 of the leading edge 34. The cooling fluids may then pass through exhaust orifice 52, as shown in FIG. 5, or film cooling orifice 54. Cooling fluids may also pass into the first outboard channel 66 of the pressure side serpentine cooling channel 14, through the first inboard channel 68, through the second outboard channel 70, and may be exhausted through film cooling orifices 54. The cooling fluids may flow generally toward the trailing edge 36. Cooling fluids may also pass into the first outboard channel 78 of the suction side serpentine cooling channel 16, through the first inboard channel 80, through the second outboard channel 82, and may be exhausted through film cooling orifices 54 and the exhaust orifice 88 in the tip 32. The cooling fluids may flow generally toward the leading edge 34 in the suction side serpentine cooling channel 16. The cooling fluids may enter the trailing edge cooling channel 40, pass through the impingement orifices 58, and be exhausted through the trailing edge exhaust orifices 62 or exhaust orifice 60 in the tip 32. The cooling fluids flowing in this manner flow counter to each other in the pressure and suction side cooling channels 14, 16.

Figure 6:
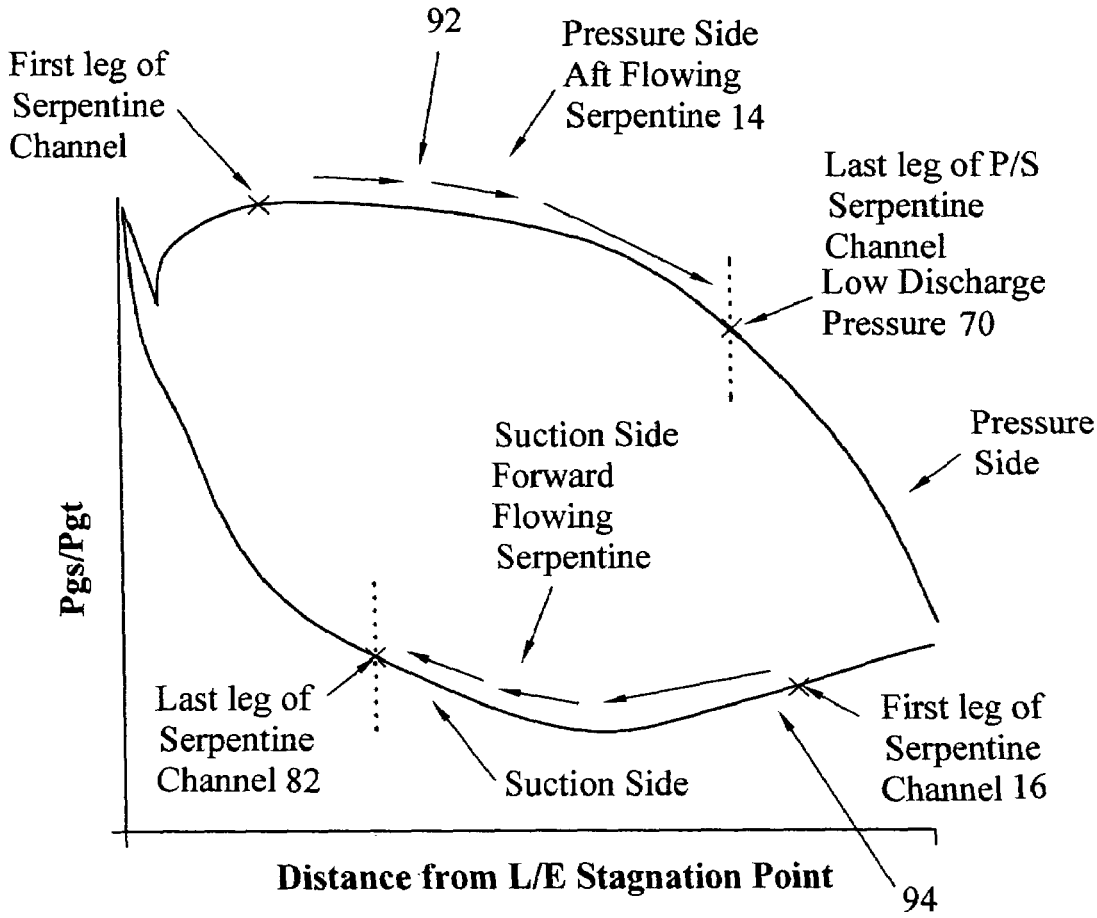
FIG. 6 is a graph of the pressure profile of the cooling system of an embodiment of the invention.

FIG. 6 displays the pressure profile 92 of the external hot gases and the pressures of the cooling fluids flowing through the pressure side serpentine cooling channel 14 and a suction profile 94 of the cooling fluids flowing through the suction side serpentine cooling channel 16. The graph displays how the invention customizes the pressures in the pressure and suction side serpentine cooling channels 14, 16 to maximize the cooling fluid flow efficiencies. The cooling system 12 is designed based on the mainstream gas pressure distribution. The pressure side serpentine cooling channel 14 begins proximate to the leading edge cooling channel 38, where the mainstream gas pressure is relatively high. The pressure of the cooling fluids in the pressure side cooling channel 14 is slightly greater than the outside gas pressure to create a positive outflow margin (OFM). Because the pressure side serpentine cooling channel 14 does not exhaust cooling fluids from the first outboard channel 66, the pressure of the cooling fluids in the first outboard channel 66 does not need to be as high as conventional pressures, which are about 10 percent greater than the mainstream gas pressure outside the turbine airfoil 10. Rather, the pressure of the cooling fluids in the first outboard channel 66 may be about three percent greater than the mainstream gas pressure outside the turbine airfoil 10. As the cooling fluids flow through sections of the pressure side serpentine cooling channel 14 downstream of the first outboard channel 66, such as the first inboard channel 68 and second outboard channel 70, the pressure of the cooling fluids is reduced due to resistance from turns and trips strips. However, the pressure of the mainstream gases outside of the turbine airfoil 10 are also reduced moving toward the trailing edge 36, and thus enables the second outboard channel 70 to have a back flow margin (BFM) of about 10 percent. In contrast, a conventional serpentine cooling must establish a much higher pressure gradient initially in the first outboard channel in order to maintain a proper BFM in the downstream cooling channels. Thus, conventional designs are less efficient than the instant invention.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated airfoil formed from an outer wall, a leading edge, a trailing edge, a pressure side, a suction side, a tip at a first end, a root coupled to the airfoil at an end generally opposite the first end for supporting the airfoil and for coupling the airfoil to a disc, and at least one cavity in the elongated airfoil forming a cooling system in the airfoil;

wherein the cooling system comprises a pressure side serpentine cooling channel formed from a first outboard channel, a first inboard channel coupled to an outboard end of the first outboard channel and extending toward the root, and a second outboard channel coupled to an inboard end of the first inboard channel and extending toward the tip;

a suction side serpentine cooling channel formed from a first outboard channel and a first inboard channel coupled to an outboard end of the first outboard channel and extending toward the root;

wherein the first outboard channel of the suction side serpentine cooling channel is positioned between the second outboard channel of the pressure side serpentine cooling channel and the trailing edge of the airfoil, and the first inboard channel of the suction side serpentine cooling channel is positioned between the first inboard channel of the pressure side serpentine cooling channel and second outboard channel of the pressure side serpentine cooling channel; and wherein cooling fluids in the pressure side serpentine cooling channel flow in a general direction from the leading edge toward the trailing edge and cooling fluids in the suction side serpentine cooling channel flow in a general direction from the trailing edge toward the leading edge.

2. The turbine airfoil of claim 1, further comprising a second outboard channel of the suction side serpentine cooling channel coupled to an inboard end of the first inboard channel of the suction side serpentine cooling channel and extending toward the tip and positioned chordwise between the first inboard channel of the pressure side serpentine cooling channel and the first inboard channel of the suction side serpentine cooling channel.

3. The turbine airfoil of claim 2, further comprising an orifice extending between an outboard end of the second outboard channel of the suction side serpentine cooling channel and the tip.

4. The turbine airfoil of claim 1, further comprising at least one leading edge cooling channel extending generally spanwise in close proximity to the leading edge of the elongated airfoil.

5. The turbine airfoil of claim 4, further comprising a rib positioned in the at least one leading edge cooling channel having a plurality of impingement orifices.

6. The turbine airfoil of claim 4, further comprising a plurality of trip strips protruding from inner surfaces of the at least one leading edge cooling channel, and the suction side and pressure side serpentine cooling channels.

7. The turbine airfoil of claim 1, further comprising at least one trailing edge cooling chamber extending generally spanwise in close proximity to the trailing edge of the elongated airfoil.

8. The turbine airfoil of claim 7, further comprising a first spanwise rib in the at least one trailing edge cooling channel having a plurality of impingement orifices and a second spanwise rib positioned between the first spanwise rib and the trailing edge of the elongated airfoil having a plurality of impingement orifices, wherein the impingement orifices in the second rib are offset spanwise from the impingement orifices in the first rib.

9. The turbine airfoil of claim 7, further comprising a plurality of trip strips protruding from inner surfaces of the at least one leading edge cooling channel, and the suction side and pressure side serpentine cooling channels.

10. The turbine airfoil of claim 1, further comprising a cooling fluid supply chamber in the root of the elongated airfoil and wherein an inboard end of the first outboard channel of the pressure side serpentine cooling channel and an inboard end of the first outboard channel of the suction side serpentine cooling channel are coupled to the cooling fluid supply chamber.

11. The turbine airfoil of claim 1, further comprising a central cooling fluid supply channel coupled to an inboard end of the first inboard channel of the pressure side serpentine cooling channel and an inboard end of the second outboard channel of the pressure side serpentine cooling channel, wherein the central cooling fluid supply channel is separated from the cooling fluid supply channel by a plate.

12. A turbine airfoil, comprising:

a generally elongated airfoil formed from an outer wall, a leading edge, a trailing edge, a pressure side, a suction side, a tip at a first end, a root coupled to the airfoil at an end generally opposite the first end for supporting the airfoil and for coupling the airfoil to a disc, and at least one cavity in the elongated airfoil forming a cooling system in the airfoil;

wherein the cooling system comprises a pressure side serpentine cooling channel formed from a first outboard channel, a first inboard channel coupled to an outboard end of the first outboard channel and extending toward the root, and a second outboard channel coupled to an inboard end of the first inboard channel and extending toward the tip;

a suction side serpentine cooling channel formed from a first outboard channel, a first inboard channel coupled to an outboard end of the first outboard channel and extending toward the root, and a second outboard channel coupled to an inboard end of the first inboard channel and extending toward the tip of the elongated airfoil;

wherein the first outboard channel of the suction side serpentine cooling channel is positioned between the second outboard channel of the pressure side serpentine cooling channel and the trailing edge of the airfoil, and the first inboard channel and the second outboard channel of the suction side serpentine cooling channel are positioned between the first inboard channel of the pressure side serpentine cooling channel and second outboard channel of the pressure side serpentine cooling channel; and wherein cooling fluids in the pressure side serpentine cooling channel flow in a general direction from the leading edge toward the trailing edge and cooling fluids in the suction side serpentine cooling channel flow in a general direction from the trailing edge toward the leading edge.

13. The turbine airfoil of claim 12, further comprising an orifice extending between an outboard end of the second outboard channel of the suction side serpentine cooling channel and the tip.

14. The turbine airfoil of claim 12, further comprising at least one leading edge cooling channel extending generally spanwise in close proximity to the leading edge of the elongate airfoil with a plurality of impingement orifices positioned in a spanwise rib positioned in the at least one leading edge cooling channel.

15. The turbine airfoil of claim 14, further comprising a plurality of trip strips protruding from inner surfaces of the at least one leading edge cooling channel, and the suction side and pressure side serpentine cooling channels.

16. The turbine airfoil of claim 12, further comprising at least one trailing edge cooling chamber extending generally spanwise in close proximity to the trailing edge of the elongated airfoil having a plurality of impingement orifices positioned in a first spanwise rib in the at least one trailing edge cooling channel and a plurality of impingement orifices in a second spanwise rib positioned between the first spanwise rib and the trailing edge of the elongated airfoil, wherein the impingement orifices in the second rib are offset spanwise from the impingement orifices in the first rib.

17. The turbine airfoil of claim 16, further comprising a plurality of trip strips protruding from inner surfaces of the at least one leading edge cooling channel, and the suction side and pressure side serpentine cooling channels.

18. The turbine airfoil of claim 12, further comprising a cooling fluid supply chamber in the root of the elongated airfoil and wherein an inboard end of the first outboard channel of the pressure side serpentine cooling channel and an inboard end of the first outboard channel of the suction side serpentine cooling channel are coupled to the cooling fluid supply chamber.

19. The turbine airfoil of claim 12, further comprising a central cooling fluid supply channel coupled to an inboard end of the first inboard channel of the pressure side serpentine cooling channel and an inboard end of the second outboard channel of the pressure side serpentine cooling channel, wherein the central cooling fluid supply channel is separated from the cooling fluid supply channel by a plate.

20. A turbine airfoil, comprising:

a generally elongated airfoil formed from an outer wall, a leading edge, a trailing edge, a pressure side, a suction side, a tip at a first end, a root coupled to the airfoil at an end generally opposite the first end for supporting the airfoil and for coupling the airfoil to a disc, and at least one cavity in the elongated airfoil forming a cooling system in the airfoil;

wherein the cooling system comprises a pressure side serpentine cooling channel formed from a first outboard channel and a first inboard channel coupled to an outboard end of the first outboard channel and extending toward the root;

a suction side serpentine cooling channel formed from a first outboard channel and a first inboard channel coupled to an outboard end of the first outboard channel and extending toward the root;

wherein the first outboard and first inboard channels of the suction side serpentine cooling channel are positioned between the first outboard channel and the first inboard channel of the pressure side serpentine cooling channel; and wherein cooling fluids in the pressure side serpentine cooling channel flow in a general direction from the leading edge toward the trailing edge and cooling fluids in the suction side serpentine cooling channel flow in a general direction from the trailing edge toward the leading edge.

* * * * *